US007435478B2

(12) United States Patent
Keshavan

(10) Patent No.: US 7,435,478 B2
(45) Date of Patent: Oct. 14, 2008

(54) CUTTING STRUCTURES

(75) Inventor: Madapusi K. Keshavan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 48 days.

(21) Appl. No.: 11/044,651

(22) Filed: Jan. 27, 2005

(65) Prior Publication Data

US 2006/0165993 A1 Jul. 27, 2006

(51) Int. Cl.
*B32B 9/00* (2006.01)

(52) U.S. Cl. ..... 428/408; 51/307; 51/309; 428/212; 428/698; 428/704

(58) Field of Classification Search ..... 428/408, 428/704, 698, 212; 51/307, 309
See application file for complete search history.

(56) References Cited

U.S. PATENT DOCUMENTS

| | | | | | |
|---|---|---|---|---|---|
| 4,288,248 | A | | 9/1981 | Bovenkerk et al. | |
| 4,403,015 | A | | 9/1983 | Nakai | |
| 4,505,746 | A | | 3/1985 | Nakai | |
| 4,959,929 | A | * | 10/1990 | Burnand et al. | 51/307 |
| 5,011,514 | A | * | 4/1991 | Cho et al. | 51/295 |
| 5,510,193 | A | | 4/1996 | Cerutti | |
| 5,560,716 | A | * | 10/1996 | Tank et al. | 428/408 |
| 5,603,070 | A | | 2/1997 | Cerutti | |
| 5,645,617 | A | * | 7/1997 | Frushour | 51/309 |
| 6,041,875 | A | * | 3/2000 | Rai et al. | 175/428 |
| 6,063,333 | A | * | 5/2000 | Dennis | 419/6 |
| 6,193,001 | B1 | | 2/2001 | Eyre et al. | |
| 6,344,149 | B1 | * | 2/2002 | Oles | 216/11 |
| 6,544,308 | B2 | * | 4/2003 | Griffin et al. | 428/408 |
| 6,592,985 | B2 | * | 7/2003 | Griffin et al. | 428/212 |

FOREIGN PATENT DOCUMENTS

| | | | |
|---|---|---|---|
| EP | 0272913 | | 6/1988 |
| EP | 0706981 | | 4/1996 |
| EP | 1 190 791 | * | 3/2002 |
| RU | 2 034 937 | * | 5/1995 |

OTHER PUBLICATIONS

Canadian Official Action issued in Canadian Application No. 2,532,773 dated Apr. 25, 2006 (3 pages).
Examination Report issued in Application No. GB0600422.0 dated May 14, 2007 (2 pages).
Canadian Official Action issued in Canadian Application No. 2,532,773 dated Nov. 29, 2007 (3 pages).
Combined Search and Examination Report issued in Application No. GB0600422.0 dated May 3, 2006 (5 pages).

* cited by examiner

*Primary Examiner*—Archene Turner
(74) *Attorney, Agent, or Firm*—Osha Liang LLP

(57) ABSTRACT

A polycrystalline diamond compact cutter that includes a thermally stable polycrystalline diamond layer, a carbide substrate, and a polycrystalline cubic boron nitride layer interposed between the thermally stable polycrystalline diamond layer and the carbide substrate is disclosed. A method of forming a polycrystalline diamond compact cutter that includes the steps of providing a carbide substrate, disposing a polycrystalline cubic boron nitride layer on the carbide substrate, disposing a polycrystalline diamond layer on the polycrystalline cubic boron nitride layer, and treating at least a portion of the polycrystalline diamond layer to form a thermally stable polycrystalline diamond layer is also disclosed.

18 Claims, 2 Drawing Sheets

CUTTING STRUCTURES

BACKGROUND OF INVENTION

1. Field of the Invention

The invention relates generally to drill bits which have polycrystalline diamond compact ("PDC") cutters thereon.

2. Background Art

Polycrystalline diamond compact ("PDC") cutters have been used in industrial applications including rock drilling and metal machining for many years. In a typical application, a compact of polycrystalline diamond (or other superhard material) is bonded to a substrate material, which is typically a sintered metal-carbide to form a cutting structure. A PDC comprises a polycrystalline mass of diamonds (typically synthetic) that are bonded together to form an integral, tough, high-strength mass or lattice.

An example of a rock bit for earth formation drilling using PDC cutters is disclosed in U.S. Pat. No. 5,186,268. FIGS. 1 and 2 from that patent show a rotary drill having a bit body 10. The lower face of the bit body 10 is formed with a plurality of blades 16-25, which extend generally outwardly away from a central longitudinal axis of rotation 15 of the drill bit. A plurality of PDC cutters 26 are disposed side by side along the length of each blade. The number of PDC cutters 26 carried by each blade may vary. The PDC cutters 26 are individually brazed to a stud-like carrier (or substrate), which may be formed from tungsten carbide, and are received and secured within sockets in the respective blade.

A PDC cutter may be formed by placing a cemented carbide substrate into the container of a press. A mixture of diamond grains or diamond grains and catalyst binder is placed atop the substrate and treateed under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn bonded to the substrate. The substrate often comprises a metal-carbide composite material, such as tungsten carbide. The deposited diamond layer is often referred to as the "diamond table" or "abrasive layer."

One of the major factors in determining the longevity of PDC cutters is the strength of the bond between the polycrystalline diamond layer and the sintered metal carbide substrate. For example, analyses of the failure mode for drill bits used for earth formation drilling show that in approximately one-third of the cases, bit failure or wear is caused by delamination of the diamond table from the metal carbide surface.

Many prior art PDC cutters have the diamond table deposited on a substrate having a planar interface. However, in an attempt to reduce the incidents of delamination at the PDC/metal carbide interface, several prior art systems have incorporated substrates having a non-planar geometry to form a non-planar interface. U.S. Pat. No. 5,494,477 discloses cutters having a non-planar interface. FIG. 3 illustrates one embodiment of a PDC cutter having a non-planar interface. As shown in FIG. 3, PDC 110 includes a plurality of sloped surfaces 114, 115 between the substrate 111 and the abrasive layer 112.

Additionally, other prior art systems have incorporated an intermediate layer between the diamond layer and the substrate to reduce these stresses. U.S. Pat. No. 5,510,193 discloses an intermediate layer of polycrystalline cubic boron nitride between a PDC layer and a cemented metal carbide support layer. Further, in the '193 patent, the metal binder, i.e., cobalt, is substantially swept from the metal carbide support layer into the intermediate layer and into the PDC layer. The '193 patent contributes the observed physical properties and interlayer bond strengths of the '193 compact to the sweeping through of the cobalt into the intermediate and PDC layers.

Furthermore, an additional factor in determining the longevity of PDC cutters is the heat that is produced at the cutter contact point, specifically at the exposed part of the PDC layer. The thermal operating range of PDC cutters is typically 750° C. or less. Temperatures higher than 750° C. produce rapid wear of the cutter because of differential thermal expansion between cobalt and diamond in the PDC layer, which may result in delamination. This thermal expansion also jeopardizes the bond strength between the diamond table and the carbide substrate.

Accordingly, there exists a need for thermally stable PDC cutters having a decreased risk of delamination.

SUMMARY OF INVENTION

In one aspect, the present invention relates to a polycrystalline diamond compact cutter that includes a thermally stable polycrystalline diamond layer, a carbide substrate, and a polycrystalline cubic boron nitride layer interposed between the thermally stable polycrystalline diamond layer and the carbide substrate.

In another aspect, the invention relates to a polycrystalline diamond compact cutter that includes a thermally stable polycrystalline diamond layer, a carbide substrate, and at least two polycrystalline cubic boron nitride layers interposed between the thermally stable polycrystalline diamond layer and the carbide substrate.

In yet another aspect, the invention relates to a method for forming a polycrystalline diamond compact cutter that includes the steps of providing a carbide substrate, disposing a polycrystalline cubic boron nitride layer on the carbide substrate, disposing a polycrystalline diamond layer on the polycrystalline cubic boron nitride layer, and treating at least a portion of the polycrystalline diamond layer to form a thermally stable polycrystalline diamond layer.

Other aspects and advantages of the invention will be apparent from the following description and the appended claims.

DETAILED DESCRIPTION

In one aspect, embodiments of the invention relate to a polycrystalline diamond compact cutter disposed on a support. In particular, embodiments of the present invention relate to a thermally stable polycrystalline diamond compact cutter for use with a PDC bit. Moreover, the invention relates to a method for forming such cutters.

Figure 1:
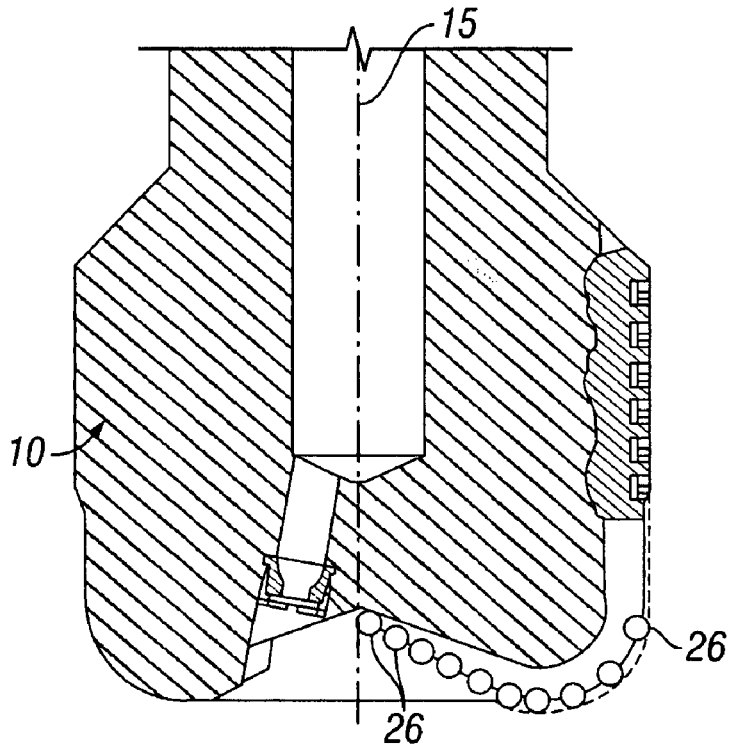
FIG. 1 (Prior Art)
FIG. 1 is an illustration of a prior art drill bit having PDC cutters.
Figure 2:
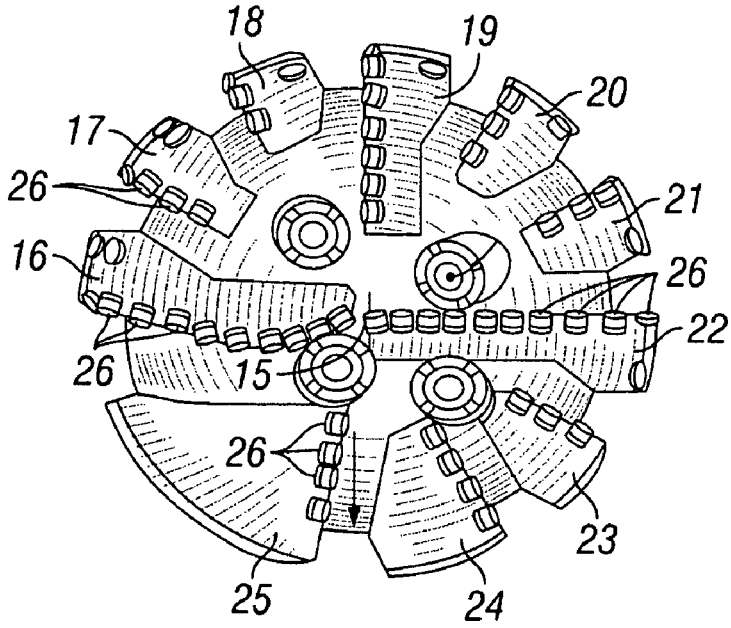
FIG. 2 (Prior Art)
FIG. 2 is an illustration of a prior art drill bit having PDC cutters.
Figure 3:
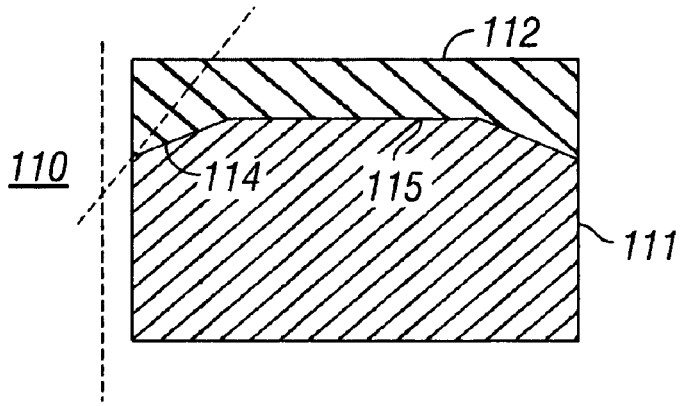
FIG. 3 (Prior Art)
FIG. 3 is an illustration of a cross-sectional view of a prior art PDC cutter having a non-planar surface.
Figure 4:
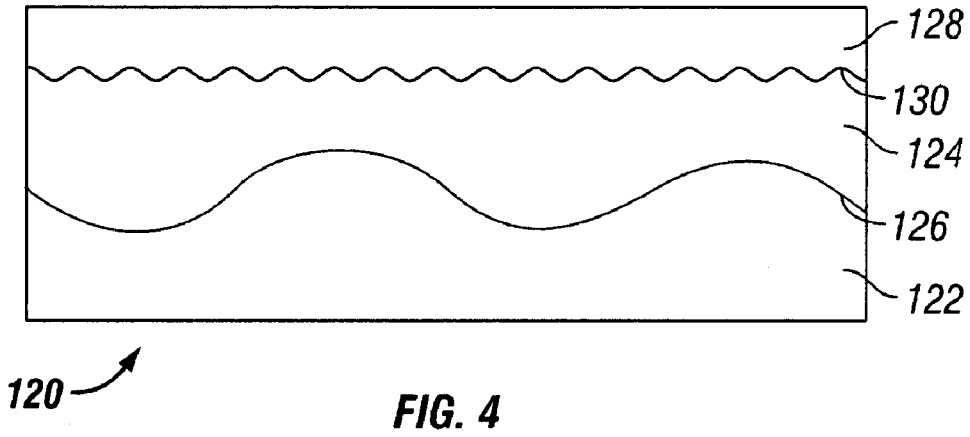
FIG. 4 illustrates one embodiment of a PDC cutter in accordance with the present invention.

Referring to FIG. 4, a novel cutting element in accordance with an embodiment of the invention is shown. In this embodiment, as shown in FIG. 4, the PDC cutter 120 includes an underlying layer of a carbide substrate 122. A polycrystalline cubic boron nitride layer 124 is disposed on the carbide substrate 122, creating a first interface 126 between the carbide substrate 122 and the polycrystalline cubic boron nitride layer 124. A thermally stable polycrystalline diamond compact layer 128 is disposed on the polycrystalline cubic boron nitride layer 124, creating a second interface 130 between the polycrystalline cubic boron nitride layer 124 and the thermally stable polycrystalline diamond compact layer 128. According to the embodiment shown in FIG. 4 the first interface 126 and the second interface 130 have non-planar geometries. In accordance with some embodiments of the invention, the first interface 126 and/or the second interface 130 have planar geometries (not shown separately). In this particular embodiment, a tungsten carbide substrate is used.

Figure 5:
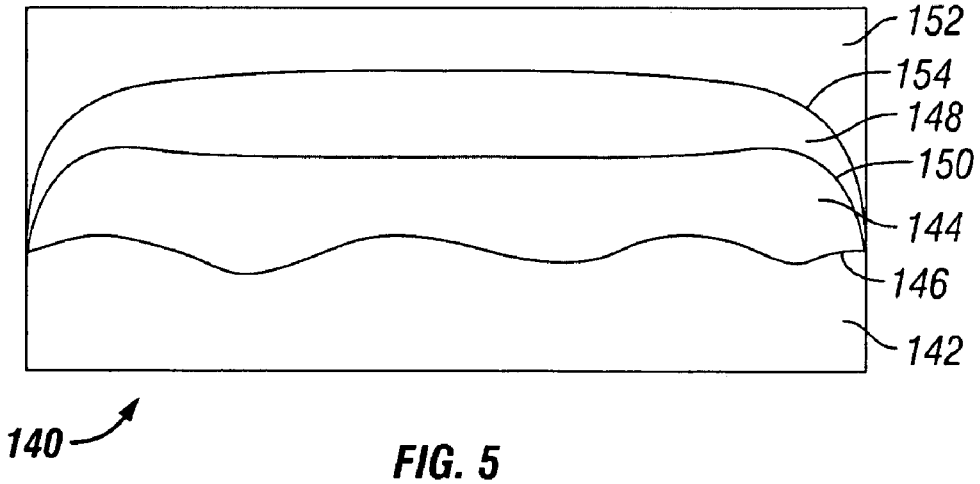
FIG. 5 illustrates one embodiment of a PDC cutter in accordance with the present invention.

Referring to FIG. 5, a second PDC cutter in accordance with an embodiment of the present invention is shown. In this embodiment, as shown in FIG. 5, the PDC cutter 140 includes a carbide substrate 142. A first polycrystalline cubic boron nitride layer 144 is disposed on the carbide substrate 142 creating a first interface 146 between the carbide substrate 142 and the first polycrystalline cubic boron nitride layer 144. A second polycrystalline cubic boron nitride layer 148 is disposed on the first polycrystalline cubic boron nitride layer 144 creating a second interface 150 between the first polycrystalline cubic boron nitride layer 144 and the second polycrystalline cubic boron nitride layer 148. A thermally stable polycrystalline diamond compact layer 152 is disposed on the second polycrystalline cubic boron nitride layer 148, creating a third interface 154 between the second polycrystalline cubic boron nitride layer 148 and the thermally stable polycrystalline diamond compact layer 152.

In one embodiment of the invention, the carbide substrate may include a metal carbide, such as tungsten carbide. The metal carbide grains may be supported within a metallic binder, such as cobalt. Additionally, the carbide substrate may be formed of a sintered tungsten carbide composite substrate. It is well known that various metal carbide compositions and binders may be used, in addition to tungsten carbide and cobalt. Further, references to the use of tungsten carbide and cobalt are for illustrative purposes only, and no limitation on the type of carbide or binder used is intended.

According to one embodiment of the invention, the polycrystalline cubic boron nitride interlayer includes a content of cubic boron nitride of at least 50% by volume by volume. According to another embodiment of the invention, the polycrystalline cubic boron nitride includes a content of cubic boron nitride of at least 70% by volume. According to yet another embodiment of the present invention, the polycrystalline cubic boron nitride layer includes a content of cubic boron nitride of at least 85% by volume.

In one embodiment of the present invention, the residual content of the polycrystalline cubic boron nitride interlayer may include at least one of Al, Si, and mixtures thereof, carbides, nitrides, carbonitrides and borides of Group 4a, 5a, and 6a transition metals of the periodic table. Mixtures and solid solutions of Al, Si, carbides, nitrides, carbonitrides and borides of Group 4a, 5a, and 6a transition metals of the periodic table may also be included.

In another embodiment of the present invention, the residual content of the polycrystalline diamond layer may include TiN, TiCN, TiAlCN or mixtures thereof and at least one aluminum containing material which may be selected from aluminum, aluminum nitride, aluminum diboride ($Al_6B_{12}$), and cobalt alumnide ($CO_2Al_9$). Cobalt aluminide may include compounds with different stoichiometries, such as $Co_2Al_5$; however, $Co_2Al_9$ is preferable since it has a melting temperature of 943° C., well below the melting temperature of the cobalt phase. Use of cobalt aluminide may provide for a polycrystalline cubic boron nitride layer having a higher proportion of cubic boron nitride, as well as greater intercrystalline bonding between cubic boron nitride.

The polycrystalline cubic boron nitride layer interposed between the polycrystalline diamond layer and the substrate may create a gradient with respect to the thermal expansion coefficients for the layers. The magnitude of the residual stresses at the interfaces depends on the disparity between the thermal expansion coefficients and elastic constants for various layers. The coefficient of thermal expansion for the metal substrate may be greater than that of the polycrystalline cubic boron nitride layer, which may be greater than that of the polycrystalline diamond layer.

In yet another embodiment, referring back to FIG. 4, the polycrystalline cubic boron nitride layer 124 may include at least two regions, an inner region and an outer region (not shown separately). The inner region and outer region of the polycrystalline cubic boron nitride layer differ from each other in their contents, specifically, in their cubic boron nitride contents. The outer region of the polycrystalline cubic boron nitride layer, for example, may contain a greater percentage by volume of cubic boron nitride as compared to the inner region of the polycrystalline cubic boron nitride layer.

The polycrystalline cubic boron nitride layer may be formed from a mass of cubic boron nitride particles disposed on the carbide substrate in a process involving high pressure and high temperature. Examples of high pressure, high temperature (HPHT) processes can be found, for example, in U.S. Pat. No. 5,510,193 issued to Cemetti, et al. Briefly, an unsintered mass of crystalline particles, such as diamond and cubic boron nitride, is placed within a metal enclosure of the reaction cell of a HPHT apparatus. With the crystalline particles, a metal catalyst, such as cobalt, and a pre-formed metal carbide substrate may be included with the unsintered mass of crystalline particles. The reaction cell is then placed under processing conditions sufficient to cause the intercrystalline bonding between particles. Additionally, if the metal carbide substrate was included, the processing conditions can join the sintered crystalline particles to the substrate. A suitable HPHT apparatus for this process is described in U.S. Pat. Nos. 2,947,611; 2,941,241; 2,941,248; 3,609,818; 3,767,371; 4,289,503; 4,732,414; and 4,954,139.

Application of HPHT processing will cause the cubic boron nitride particles to sinter and form a polycrystalline layer. Similarly, the polycrystalline diamond compact layer may be formed by placing a powdered mass of crystalline diamond particles on the polycrystalline cubic boron nitride layer and applying HPHT processing to effectuate a polycrystalline diamond compact layer.

Alternatively, the polycrystalline cubic boron nitride layer and the polycrystalline diamond compact layer may be formed simultaneously by placing a mass of cubic boron nitride particles on the carbide substrate and a mass of crystalline diamond particles on the mass of cubic boron nitride particles. Application of HPHT processing will effectively sinter both layers simultaneously. The polycrystalline diamond layer may be further treated so as to form a thermally stable polycrystalline diamond compact layer having a desired thickness (e.g., greater than 0.010 inches) at its cutting edge. The thermally stable polycrystalline diamond compact, the polycrystalline cubic boron nitride and the carbide substrate may be bonded together using any method known in the art for such bonding.

The polycrystalline diamond layer includes individual diamond "crystals" that are interconnected. The individual diamond crystals thus form a lattice structure. A metal catalyst, such as cobalt may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

In order to obviate this problem, strong acids may be used to "leach" the cobalt from the diamond lattice structure. Examples of "leaching" processes can be found, for example in U.S. Pat. Nos. 4,288,248 and 4,104,344. Briefly, a hot strong acid, e.g., nitric acid, hydrofluoric acid, hydrochloric acid, or perchloric acid, or combinations of several strong acids may be used to treat the diamond table, removing at least a portion of the catalyst from the PDC layer.

Removing the cobalt causes the diamond table to become more heat resistant, but also causes the diamond table to be more brittle. Accordingly, in certain cases, only a select portion (measured either in depth or width) of a diamond table is leached, in order to gain thermal stability without losing impact resistance. As used herein, thermally stable polycrystalline diamond compacts include both of the above (i.e., partially and completely leached) compounds. In one embodiment of the invention, only a portion of the polycrystalline diamond compact layer is leached. For example, a polycrystalline diamond compact layer having a thickness of 0.010 inches may be leached to a depth of 0.006 inches. In other embodiments of the invention, the entire polycrystalline diamond compact layer may be leached.

In another embodiment, a PDC cutter according to the present invention may have a non-planar interface between the carbide substrate and the polycrystalline cubic boron nitride layer thereon. In other embodiments, a PDC cutter according to the present invention may have a non-planar interface between the polycrystalline cubic boron nitride layer and the thermally stable polycrystalline diamond compact layer. A non-planar interface between the substrate and polycrystalline cubic boron nitride layer increases the surface area of a substrate, thus improving the bonding of the polycrystalline cubic boron nitride layer to it. Similarly, a non-planar interface between the polycrystalline cubic boron nitride layer and the thermally stable polycrystalline diamond layer increases the surface area of the polycrystalline cubic boron nitride layer, thus improving the bonding of the thermally stable polycrystalline diamond compact layer. In addition, the non-planar interfaces increase the resistance to shear stress that often results in delamination of the PDC tables.

One example of a non-planar interface between a carbide substrate and a diamond layer is described, for example, in U.S. Pat. No. 5,662,720, wherein an "egg-carton" shape is formed into the substrate by a suitable cutting, etching, or molding process. Other non-planar interfaces may also be used, for example, the interface described in U.S. Pat. No. 5,494,477. The substrate surface may be, for example, a sintered metal-carbide, such as tungsten carbide as in previous embodiments. According to one embodiment of the present invention, a polycrystalline cubic boron nitride layer is deposited onto the substrate having a non-planar surface.

In accordance with some embodiments of the invention, the interface between the polycrystalline diamond compact layer and the polycrystalline cubic boron nitride layer may be non-planar. In accordance with other embodiments of the invention, both the interface between the substrate and the polycrystalline cubic boron nitride layer and the interface between the polycrystalline cubic boron nitride layer and the polycrystalline diamond compact layer may be non-planar. In accordance with yet other embodiments of the invention, the non-planar interfaces have mismatched geometries.

Advantages of the embodiments of the invention may include one or more of the following. A PDC cutter including a thermally stable polycrystalline diamond compact layer, a polycrystalline cubic boron nitride layer, and a metal substrate would allow for greater bond strength to the substrate, preventing delamination while also allowing for the PDC cutter to be used at larger temperature range. A completely leached polycrystalline diamond compact layer allows for the presence of cobalt in the polycrystalline cubic boron nitride layer, which is juxtaposed to the substrate, while removing it from the polycrystalline diamond compact layer which contacts the earth formation. Additionally, a partially leached polycrystalline diamond compact layer allows for the presence of some cobalt while removing it from the region that would experience the greatest amounts of thermal expansion.

The gradient of thermal expansion coefficients between thermally stable polcrystalline diamond layer, the polycrystalline cubic boron nitride layer and the metal substrate reduces residual stresses in the PDC cutter and the incidents of delamination of the diamond layer by interposing an layer with a lower thermal expansion coefficient, as compared to the substrate, next to the diamond layer. Further, the residual components of the polycrystalline cubic boron nitride layer have a high affinity for cobalt, further contributing to the strength of the bonds between the substrate and the polycrystalline cubic boron nitride layer.

The non-planar interface between the substrate and the polycrystalline cubic boron nitride layer and the non-planar interface between the polycrystalline cubic boron nitride layer and the thermally stable polycrystalline diamond compact layer allow for greater bonding between the layers and high resistance to shear stress that often results in delamination. Further, a PDC cutter having non-planar interfaces with mismatched geometries prevents cracking.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A polycrystalline diamond compact cutter, comprising:

a thermally stable polycrystalline diamond layer formed from a polycrystalline diamond layer having binder material removed from the entire layer thickness;

a carbide substrate; and a polycrystalline cubic boron nitride layer interposed between the thermally stable polycrystalline diamond layer and the carbide substrate, wherein the polycrystalline cubic boron nitride layer has a cubic boron nitride content of at least 70% by volume.

2. The polycrystalline diamond compact cutter of claim 1, wherein the polycrystalline cubic boron nitride layer comprises one of Al, Si, and a mixture thereof.

3. The polycrystalline diamond compact cutter of claim 1, wherein the polycrystalline cubic boron nitride layer further comprises at least one selected from a carbide, a nitride, a carbonitride, and a boride of a Group 4a, 5a, and 6a transition metal.

4. The polycrystalline diamond compact cutter of claim 1, wherein the polycrystalline cubic boron nitride layer comprises an inner region and an outer region differing in cubic boron nitride content.

5. The polycrystalline diamond compact cutter of claim 4, wherein the cubic boron nitride content of the outer region is greater than the cubic nitride content of the inner region.

6. The polycrystalline diamond compact cutter of claim 1, wherein the thermally stable polycrystalline diamond layer has a cutting edge with a thickness of at least 0.010 inches.

7. The polycrystalline diamond compact cutter of claim 1, wherein an interface between the carbide substrate and the polycrystalline cubic boron nitride layer is non-planar.

8. The polycrystalline diamond compact cutter of claim 1, wherein an interface between the polycrystalline diamond layer and the polycrystalline cubic boron nitride layer is non-planar.

9. The polycrystalline diamond compact cutter of claim 8, wherein an interface between the carbide substrate and the polycrystalline cubic boron nitride layer is non-planar.

10. The polycrystalline diamond compact cutter of claim 1, wherein the polycrystalline cubic boron nitride layer has a cubic boron nitride content of at least 85% by volume.

11. The polycrystalline diamond compact cutter of claim 1, wherein the polycrystalline cubic boron nitride layer comprises an inner polycrystalline cubic boron nitride region and an outer polycrystalline cubic boron nitride region, and wherein the outer polycrystalline cubic boron nitride region has a cubic boron nitride content greater than the inner polycrystalline cubic boron nitride region.

12. A polycrystalline diamond compact cutter, comprising:

a thermally stable polycrystalline diamond layer formed from a polycrystalline diamond layer having binder material removed from the entire layer thickness;

a carbide substrate; and at least two polycrystalline cubic boron nitride layers interposed between the thermally stable polycrystalline diamond layer and the carbide substrate, wherein the at least two polycrystalline cubic boron nitride layers have a cubic boron nitride content of at least 70% by volume.

13. The polycrystalline diamond compact cutter of claim 12, wherein at least one of the at least two polycrystalline cubic boron nitride layers comprises an inner polycrystalline cubic boron nitride layer and at least one of the at least two polycrystalline cubic boron nitride layers comprises an outer polycrystalline cubic boron nitride layer.

14. The polycrystalline diamond compact cutter of claim 13, wherein the outer polycrystalline cubic boron nitride layer has a cubic boron nitride content greater than the inner polycrystalline cubic boron nitride layer.

15. The polycrystalline diamond compact cutter of claim 12, wherein an interface between the thermally stable polycrystalline diamond layer and one of the at least two polycrystalline cubic boron nitride layers is non-planar.

16. The polycrystalline diamond compact cutter of claim 12, wherein an interface between the at least two polycrystalline cubic boron nitride layer is non-planar.

17. The polycrystalline diamond compact cutter of claim 12, wherein at least one of the two polycrystalline cubic boron nitride layers has a cubic boron nitride content of at least 85% by volume.

18. The polycrystalline diamond compact cutter of claim 12, wherein an interface between the carbide substrate and one of the at least two polycrystalline cubic boron nitride layers is non-planar.

* * * * *